United States Patent [19]

Kalt

[11] 4,354,861

[45] Oct. 19, 1982

[54] PARTICLE COLLECTOR AND METHOD OF MANUFACTURING SAME

[76] Inventor: Charles G. Kalt, 29 Hawthorne Rd., Williamstown, Mass. 01267

[21] Appl. No.: 227,576

[22] Filed: Mar. 26, 1981

[51] Int. Cl.[3] ..... B03C 3/04; B03C 3/45

[52] U.S. Cl. ..... 55/130; 55/137; 55/155; 55/520; 427/121; 427/122; 427/439

[58] Field of Search ..... 55/155–157, 55/142–143, 145, 130, 137, 520; 427/122, 439, 121

[56] References Cited

U.S. PATENT DOCUMENTS

| | | | |
|---|---|---|---|
| 1,114,665 | 10/1914 | Allen et al. | 427/122 |
| 1,541,678 | 6/1925 | Bauer | 55/155 |
| 1,992,974 | 5/1935 | Thompson | 55/155 X |
| 2,604,183 | 7/1952 | Richardson | 55/155 X |
| 2,721,154 | 10/1955 | Hopf et al. | 427/122 |
| 2,868,319 | 1/1959 | Rivers | 55/155 X |
| 2,958,393 | 11/1960 | Lueder | 55/155 |
| 4,166,729 | 9/1979 | Thompson et al. | 55/155 X |
| 4,177,047 | 12/1979 | Goland | 55/155 X |

FOREIGN PATENT DOCUMENTS

| | | | |
|---|---|---|---|
| 186047 | 1/1923 | United Kingdom | 55/155 |

*Primary Examiner*—Kathleen J. Prunner

*Attorney, Agent, or Firm*—Anthony H. Handal; Michael N. Meller

[57] ABSTRACT

An electrostatic particle collector comprising a pair of spaced, parallel, paper collector electrodes. Each electrode has a narrow high conductive region adjacent one side and a wide low conductive region in contact with the narrow high conductive region. The regions are formed by impregnating the paper electrodes with varying concentrations of a conductive material such as graphite. The narrow high conductive region of one electrode is disposed opposite and spaced from the wide low conductive region of the other electrode of the pair.

4 Claims, 9 Drawing Figures

FIG. 1
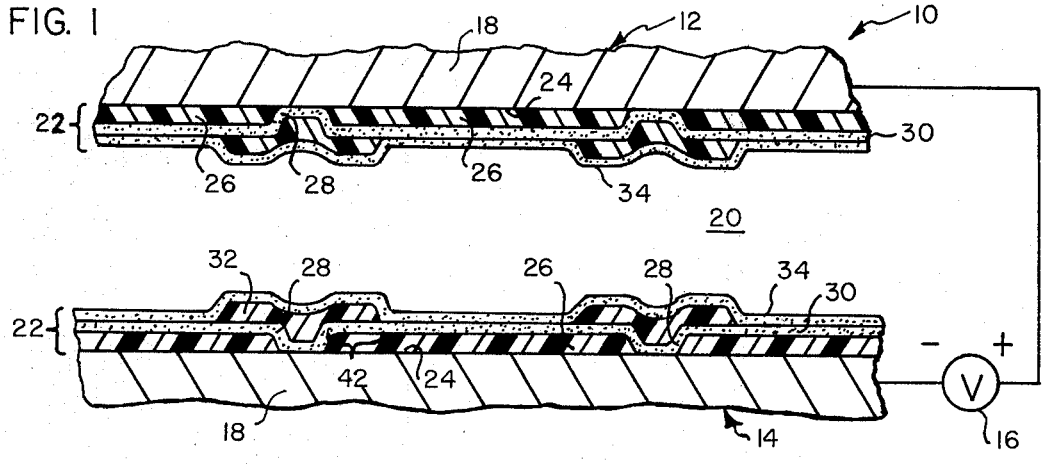
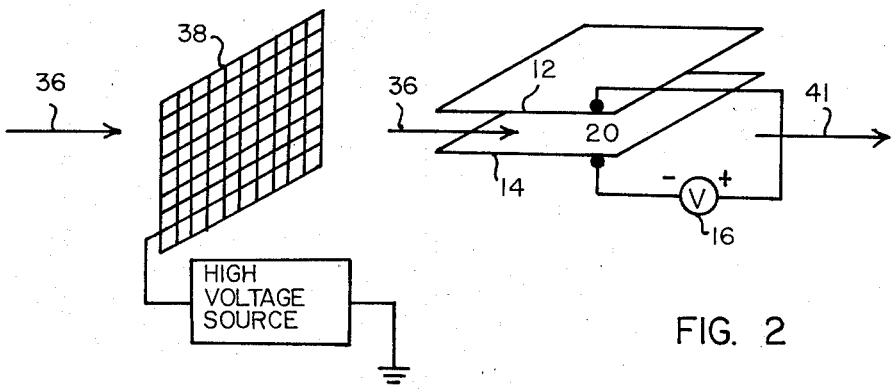
FIG. 2
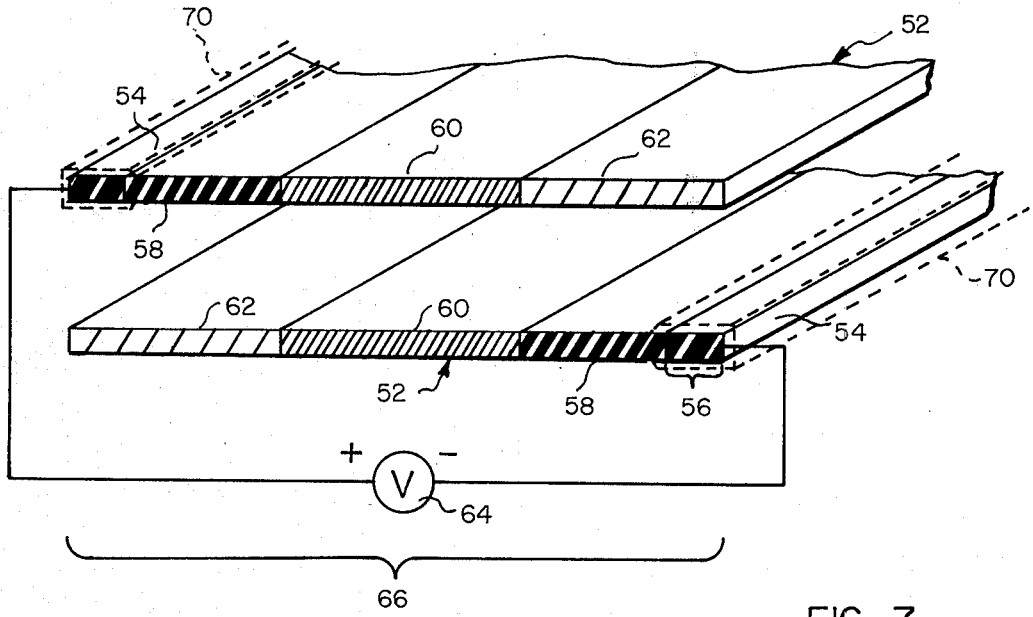
FIG. 7

PARTICLE COLLECTOR AND METHOD OF MANUFACTURING SAME

CROSS-REFERENCE TO RELATED APPLICATION

Reference is hereby made to U.S. patent application Ser. No. 972,985 (now U.S. Pat. No. 4,249,919), filed Dec. 26, 1978 of Charles G. Kalt directed to matrix type electrostatic precipitator, the disclosure of which is hereby incorporated by reference.

TECHNICAL FIELD

The invention relates to air cleaners of the type which include a passage through which air to be cleaned of entrained particles is passed and across which an electric field exists.

BACKGROUND ART

With increasing public awareness of the relatively high levels of air pollution which surround many parts of our nation, there has arisen a growing need for devices capable of cleaning the air. Such devices have a wide variety of applications, ranging from the smokestack where pollutants are produced to the homes of people living near sources of pollution. With regard to home applications, the need is particularly acute, inasmuch as many people are seriously affected by industrial pollutants as well as natural environmental particles such as pollen and the like.

One class of devices which is particularly effective in removing particles, such as pollen and soot, from the air generally includes an emitter through which air to be cleaned is passed and which is driven by an extremely high voltage power supply. The emitter usually comprises a mesh of electrically-conductive material. When it is driven with a high voltage, the mesh emits a great quantity of charge which attaches itself to airborne particles thus giving them a charge.

The air to be cleaned is driven through the emitter by a fan or any other suitable apparatus. After being driven through the emitter and having its entrained particles given an electrical charge, the air is then blown into charged conducting collector elements. The voltage on the conducting collector elements is very high and, consequently, the entrained charged particles which are blown near them are attracted to and held by the charged collector element. They accumulate on the collector element which must be periodically washed.

Typical examples of such systems include those disclosed in U.S. Pat. Nos. 3,910,779, 2,129,783, 3,988,131, 2,885,026, 2,565,458, 3,950,153, and 3,594,989. While systems of this kind are extremely effective in removing particles from the air (they have efficiencies on the order of 98%), they have a number of distinct disadvantages. The voltages required for both the emitter and the collector itself are extremely high, typically in the order of 40–60 kilovolts. The use of such high voltages necessitates the use of relatively expensive equipment to generate these voltages. Thus, such collectors may be quite expensive. Still another problem is the fact that these collectors must be cleaned frequently. This is a time consuming and clumsy operation.

Accordingly, a great deal of work has been expended in seeking alternatives to this type of collector. Perhaps the most common solution is simply to use a fiberglass or other mechanical air filter which is very inexpensive and hence can be disposed of. The use of a fiberglass filter also obviates the need for high voltage generating equipment. Such devices thus only have need of a blower and a filter and are relatively inexpensive. However, their efficiency is very low, typically on the order of about 2%.

Another approach is simply to eliminate the electrostatic collector's emitter. While the device does lose a good part of its efficiency, it has been noted that the presence of natural charges on airborne particles is sufficient to cause the collection of about 85% of such particles when they are passed between a pair of oppositely charged conductive collector elements. However, the elimination of the emitter does little to reduce the cost of the device which still requires high voltage generating equipment. Again, the relatively expensive nature of the collector elements necessitates periodic cleaning.

Perhaps one of the major problems with all of these devices is that of arcing due to the very high voltages involved. While bringing the elements closer together reduces the voltages required, the smaller gap between elements also reduces the arcing voltage.

DISCLOSURE OF INVENTION

In accordance with the present invention an air cleaning system which combines the low cost of fiberglass filter systems with the high efficiency of electrostatic air cleaning systems is provided. Its operation does not require the generation of excessively high voltages, thus eliminating the necessity for specialized high voltage generating equipment. Moreover, the unique structure of the collector elements reduces the likelihood of arcing, even with high voltages and small gaps between elements. An additional advantage of the low voltage of the inventive system is that the danger to life from high voltage shock is greatly reduced. Also, the existence of a fire hazard and the possibility of dust fire caused by arcing across gathered dust particles is greatly reduced.

In accordance with the present invention, an air cleaner adapted to admit a flow of air containing entrained particles and to remove some of the particles from the air and expel the air and any remaining particles comprises a plurality of collector elements. Means are provided for supporting the collector elements to define a plurality of passages for the flow of air therebetween. Means for concentrating electrical charges of opposite polarity on facing surfaces of adjacent collector elements is also provided, without providing a low resistance path for the direct flow of electrical currents during arcing.

BRIEF DESCRIPTION OF DRAWINGS

One way of carrying out the invention is described below with reference to the drawings which illustrate only two specific embodiments of the invention, in which:

FIG. 1 is a cross-sectional view of a particle collecting passage in accordance with the present invention;

FIG. 2 is a schematic representation of a particle collecting apparatus in accordance with present invention;

FIG. 7 is a perspective view of an alternative embodiment of the invention;

DETAILED DESCRIPTION OF THE PREFERRED EMBODIMENTS

Figure 3:
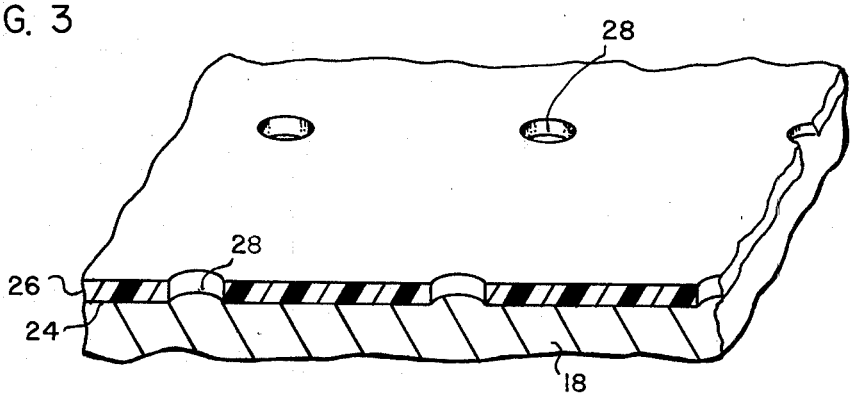
FIGS. 3–6 illustrate successive steps in the fabrication of a particle collector, such as that illustrated in FIG. 1.

Referring to FIG. 2, a typical air collecting passage for a particle collector constructed in accordance with the present invention is illustrated in schematic form. The inventive collector 10 comprises a pair of collector electrode plates 12 and 14. Plate 12 is positively charged by being connected to the positive pole of a voltage source 16. Plate 14 is negatively charged, being connected to the negative pole of source 16. The plates each comprise a planar conductive member 18 with a number of layers made of materials having different electrical properties disposed thereon, as will be described below. Members 18 are held in facing spaced relationship to each other by any one of a number of techniques. They, thus, define a passage 20 for the flow of air therebetween.

Each of the conductive members 18 has a multi-layered conductive structure 22 deposited on its surface 24, which is in facing spaced relationship to corresponding surface 24 on its respective facing electrode. Multi-layered structure 22 comprises a layer of insulative laquer 26 which defines a plurality of holes 28. A first high resistance conductive layer 30 is disposed over the layer of insulative laquer 26 and those portions of surface 24 exposed by holes 28. Patches of insulative laquer 32 are, in turn, disposed over the first high resistance conductive layer 30. Patches 32 are generally circular in configuration and centered on holes 28. Finally, a second high resistance conductive layer 34 is disposed over the entire planar surface of plates 12 and 14.

Operation of the collector is illustrated schematically in FIG. 2. During use of the inventive device, air to be cleaned is driven in the direction indicated by arrows 36 in FIG. 2. Dust particles or particles of other pollutants in the air are given a negative charge by ionizer 38, which may be an ionizer of any type well known in the prior art. The air to be cleaned, including entrained negatively charged particles is then driven between pairs of plates 12 and 14 which are electrically charged with voltages of opposite polarity. This results in the attraction of the charged particulate particles of pollutants to the plates, the effective collection of particles on the plates and, consequently, the expulsion of clean air from the collector in the direction indicated by arrow 41.

The electrical operation of the multi-layered conductive structure 22 is as follows. Insulative laquer layer 26 and insulative laquer patches 32 provide an insulative shield whose resistance is extremely high, thus preventing arcing between facing plates 12 and 14. The only path for the conduction of electricity not passing through one of these insulative layers is a high-resistance tunnel through one of the regions 42 in the first high resistance conductive layer. However, these regions are wide enough and thin enough that the resistance of such a path if still very high even though the material of which the first high resistance conductive layer is made has a much lower resistance than the layers and patches of laquer.

The first and second high resistance conductive layers on each of the facing elements 12 and 14 thus provide an excellent path for the establishment of pairs of charged planes and an electrical field therebetween. Planar conductive members 18 carry the charge to all portions of surfaces 24. Contact with the first high resistance conductive layer is made in the areas of surface 24 defined by holes 28. First high resistance conductive layer 30 in turn, makes contact with the second high resistance conductive layer 34 in the exposed areas of the first layer not covered by insulative laquer patches 32.

Thus, there is a continuous path for the conduction of electrical charges from the plates 18 to the exposed second high resistance conductive layers 34. This path extends through the first high resistance conductive layer in the area defined by holes 28 through regions 42 to the areas of first layer 30 that surround patches 32, where first layer 30 makes contact with second high resistance conductive layer 34. Because of the high resistance of the first high resistance conductive layer 30, there is a relatively large potential across regions 42. Nevertheless, an effective field exists between the two layers and conduction is sufficient to provide the bleeding of accumulated charges on captured pollutant particles. In the event of a momentary arc, the arc would quickly cease in view of the fact that region 42 will not break down, thus preventing any sustained arcing current. In general the resistance of region 42 will be chosen to be much less than the resistance of the air gap under normal operating conditions and much greater than its resistance after breakdown.

A method for making a collector electrode plate in accordance with the present invention, such as the plates illustrated in FIG. 1, is illustrated in FIGS. 3–6. One begins the process by taking a thin planar conductive member, such as aluminum foil, or mylar coated with a thin layer of conductor and depositing layer 26 of insulative laquer (FIG. 3). This may be made of any suitable material such as acrylic dissolved in a solvent. Typically, the layer would have a thickness of 2.5 micrometers. Layer 26 may be deposited to define holes 28 by utilizing silk screen techniques, stenciling, or any other suitable technique. Typically, holes 28 would have a diameter of about 1 cm.

Figure 4:
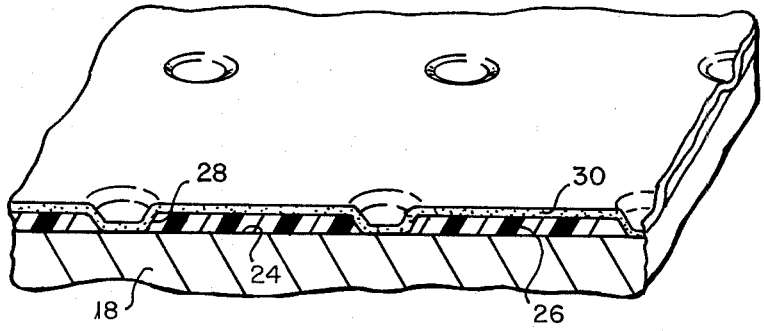

After insulative laquer layer 26 has been deposited and has dried, a thin layer 30 of high resistance yet still electrically conductive material, such as that marketed by Acheson under the designation DAG 254 suitably thinned with isopropyl alcohol, is deposited (FIG. 4). Typically, the thickness of this layer is in the order of 1 micrometer and it would have a resistance on the order of 1000 ohms per square.

Figure 5:
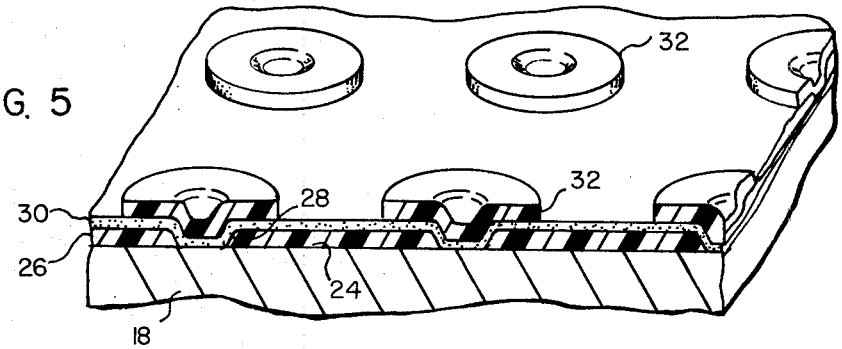

After first high resistance conductive layer 30 has been deposited, stencil or silk screen techniques are used to deposit insulative laquer patches 32 (FIG. 5). Typically, these patches have the same thickness as layer 26, are made of the same material, and have a diameter on the order of 2 cm. The center-to-center separation of patches 32 and, accordingly, holes 28 are on the order of 3 cm. Finally, the structure is completed by coating the first insulative layer 30 and the insulative laquer patches 32 with second high resistance conductive layer 34 whose electrical properties and thickness may be substantially identical to those of the first high resistance conductive layer.

The resistance of the second layer 34 is not as critical as the first layer 30 and it may desirably be of much lower resistance or even be made very highly conductive. If one desires a very highly conductive layer, the same can be achieved by vapor deposition or sputtering of aluminum over the structure illustrated in FIG. 5.

Figure 6:
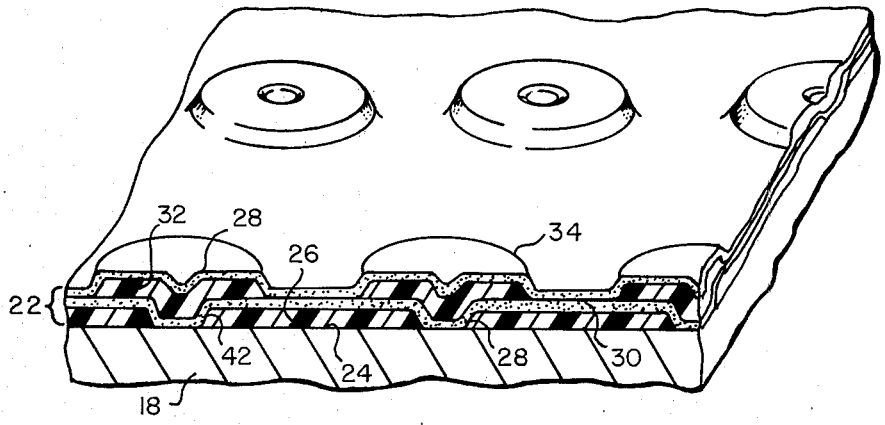

This will have the effect of completing the structure as is illustrated in FIG. 6.

An alternative embodiment of the invention is illustrated in FIG. 7. In this embodiment the electrodes comprise paper which has been graphite impregnated using a solution of DAG 254 such as that sold under the trademark AQUADAG by the Acheson Colloids Co. of Port Huron, Mich. The paper used may, typically, be twenty pound bond of the type used for writing, printing and other general uses. The amount of graphite in the various regions of the electrode varies from one region to another. In the embodiment shown in FIG. 7, the highest concentration of conductive material is in the lateral edges 54 of the elements 52. Edge region 54 would typically have a resistance on the order of ten ohms per square and a width 56 on the order of 1 cm. The next region 58 of each of the elements has much less graphite in it and, accordingly, a much higher resistance than edge region 54. Typically, the resistance of region 58 would be on the order of 10,000 ohms per square. Regions 60 on each of the electrodes 52 may be made to have a slightly higher resistance, typically on the order of 1,000,000 ohms per square. Finally, regions 62 may be made to have even a higher resistance, typically on the order of 10,000,000 to 100,000,000 ohms per square.

During operation of a collector constructed in accordance with FIG. 7 power is supplied by a source 64 which provides a high potential to the relatively highly conductive edge regions 54 to which they are electrically connected. It is contemplated that the elements would have a width 66 typically in the order of 10 cm. and a length in the order of ten meters. The electrodes would be separated from each other and supported by any suitable means and assembled in a desired configuration, such as a spiral. With respect to structures of this sort, reference is made to U.S. Pat. No. 2,650,672 of Barr et al (FIG. 13). It is expected that the separation between the electrodes will be on the order of 3 mm.

During operation, the electrical potential in relatively highly conductive edge regions 54 will be essentially constant the length of the electrodes. While conductance along the remainder of the width 66 is not as high as the conductivity of width 56; the distance is much smaller and the relatively poor conductance from one edge of the electrode to the other is nevertheless sufficient to maintain the proper charge distribution on the electrodes. Consequently, a strong electrical field exists between the electrodes. Inasmuch as region 58 serves the function of providing charge to the remainder of the electrode it has a relatively low resistance compared to regions 60 and 62. Likewise, inasmuch as region 60 provides charge to region 62, region 60 has slightly lower resistance than region 62.

It is contemplated that the inventive collector elements would be made by dipping the paper of which the electrodes are made in a diluted conductive solution, such as DAG 254, thus thoroughly saturating it with the conductive material. The paper would then be dipped in a similar though less diluted solution with regions 54, 58 and 60 submerged. After this has been completed the paper would be submerged to a shallower distance into a yet stronger liquid solution of DAG 254 with regions 54 and 58 submerged. Finally, the electrodes would be submerged in the strongest solution to the depth of submerging only region 54 and removed. The strengths of the solutions for the above submergences would depend upon the properties of the solution of DAG 254 and the properties of the paper being used. The paper would be allowed to dry between submergences, thus allowing the liquid part of the suspension to evaporate, leaving the graphite behind. The desired conductances could be most easily achieved by a trial and error process.

The advantage of the above construction is that because of the high resistance of regions 54, 60 and 62, they are not capable of providing enough current to cause sustained arcing. Indeed, the only regions capable of causing sustained arcing are the relatively low resistance edge regions 54. However, because regions 54 are diagonally opposed from each other, arcing between electrodes becomes a relatively remote possibility.

Figure 8:
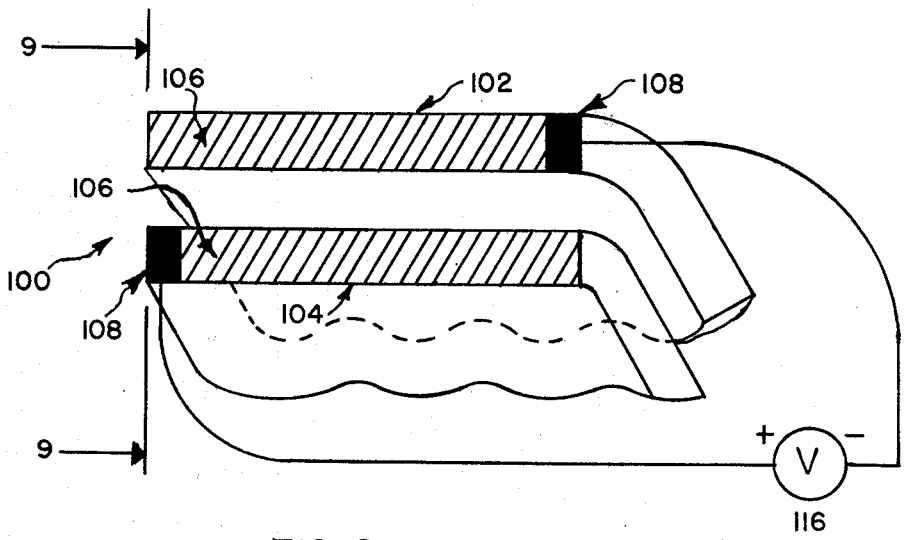
FIG. 8 is a partial perspective view of an alternative embodiment of the invention.
Figure 9:
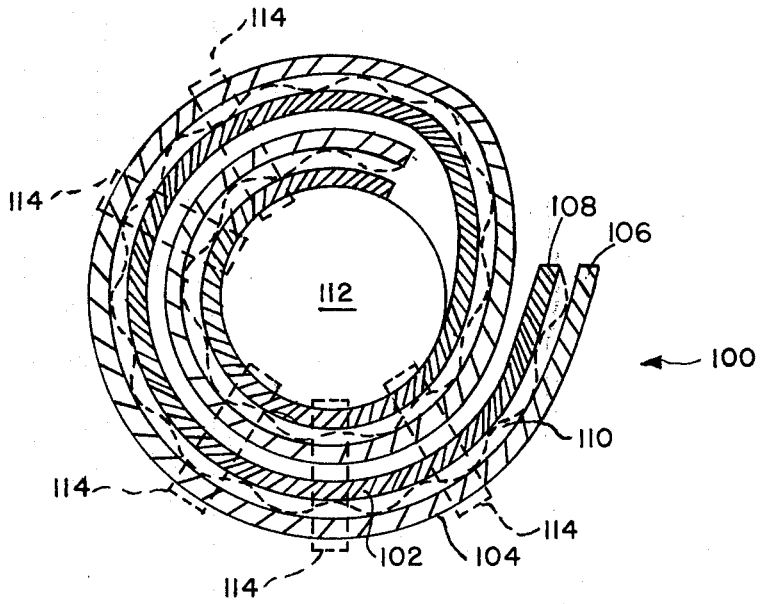
FIG. 9 is a partial view along lines 9—9 of the alternative embodiment of the invention illustrated in FIG. 8.

Another alternative embodiment of the inventive air cleaner 100 is illustrated in FIGS. 8 and 9. In this embodiment air cleaner 100 comprises a pair of electrodes 102 and 104, typically made of fiteen pound bond paper, impregnated with a conductive solution such as Staticide sold by Analytical Chemical Laboratories, Elk Grove Village, Ill. 60007. The paper could, typically, be that sold by the James River Paper Company. In FIG. 8, regions 106 designate the areas of the electrodes having a low conductance which are impregnated with the conductive solution. Regions 108 of FIG. 8 designate a region of high conductivity relative to regions 106. The comparatively high conductance of area 108 allows an electrical current to apply charge to region 106 to be uniformly distributed along the edge of electrodes 102 and 104 via regions 108. Regions 106 have a measured resistance on the order of 100,000 megohms.

It is contemplated that the areas 106 of the inventive collector elements 102 and 104 would be made by dipping the paper, of which the electrodes are to be made, into a conductive solution, such as a fifty percent Staticide (general purpose) solution, and then drying it. Once dry the electrodes 102 and 104 would be ironed flat. In pilot applications a conventional household iron could be used for this ironing. The highly conductive region 108 would subsequently be painted on by using Grapho 1311R (sold by Grapho Colloids Corp., Sharon, Pa.). After regions 106 have dried, electrodes 102 and 104 would again be ironed flat.

Two such electrodes 102 and 104, separated by a spacer 110, would be wound around a cylinder 112 to form a spiral configuration in accordance with FIG. 9. Spacer 110 could be corrugated paper. In test applications such a corrugated paper spacer 110 was scaled to result in a distance between the electrodes of approximately one-eighth on one inch. It is contemplated that spacers 110 will be removed prior to use by strengthening the structure of the spiral configuration of FIG. 9. A method for strengthening this structure is the use of 0.05 cm thick Mylar strips 114. These Mylar strips 114 could be applied with epoxy cement, enabling the removal of spacers 110. The end of cylinder 112 would be closed to prevent air flow through the cylinder itself.

During operation of a collector constructed in accordance with FIG. 9 power is supplied by a source 116 as illustrated in FIG. 8 which provides a high potential to edge regions 108. The high conductivity of regions 108 allows for a substantially constant potential along the edge of regions 108 and subsequently across the electrodes 102 and 104 themselves, thus creating an electrical field between the oppositely charged electrodes 102 and 104.

While several illustrative embodiments of the invention have been described, it is, of course, understood that various modifications may be made without departing from the spirit of the invention. For example, an insulative lip 70 could be secured around the highly conductive regions 54 in FIG. 7. Likewise, the highly conductive region 54 could be achieved by dipping paper in a colloidal suspension of graphite and allowing it to dry with region 54 on the bottom and the rest of the electrode above it, whereby gravity will pull more of the liquid suspension (and thus the graphite) to region 54 where the liquid wil evaporate and leave a high concentration of graphite in region 54. Such modifications are contemplated to be within the spirit and scope of the invention which is limited and defined only by the appended claims.

I claim:

1. A method of making an element of an electrostatic particle collector, comprising the steps of:

(a) preparing a first graphite suspension containing graphite in a first concentration;

(b) preparing a second graphite suspension containing graphite in a second lower concentration;

(c) immersing all of a porous insulative member in said second suspension; and (d) immersing a portion of said porous member in said first suspension.

2. An electrostatic particle collector, comprising a first paper support member having a length and width, and a thickness much smaller than said length and said width, said first paper support member having two longitudinal sides, said first paper support member being positioned in a spiral configuration with both longitudinal sides of said first paper support member each defining a substantially spiral configuration, said first paper support member including a narrow first region, said narrow first region having a length and a width and being positioned adjacent one of said longitudinal sides and opposite the other of said longitudinal sides, and a wide second region having a length and width and positioned adjacent said narrow first region and in contact therewith, said narrow first region having a width narrower than the width of said second region, said narrow first region being impregnated with a first concentration of a conductive material and said wide second region being impregnated with a second concentration of a conductive material, said first concentration containing a higher concentration of said conductive material than does said second concentration, a second paper support member having a length and width, and a thickness much smaller than said length and said width, said second paper support member having two longitudinal sides, said second paper support member being positioned in a spiral configuration with both longitudinal sides of said second paper support member each defining a substantially spiral configuration, said second paper support member including a narrow third region having a length and width adjacent one of said longitudinal sides and a wide fourth region having a length and a width and positioned adjacent said narrow third region and in contact therewith, said narrow third region having a width narrower than the width of said wide fourth region, said narrow third region being impregnated with a first concentration of a conductive material and said wide fourth region being impregnated with a second concentration of a conductive material, said first concentration containing a higher concentration of said conductive material than does said second concentration, said first paper support member being positioned with its wide second region in facing spaced relationship to said wide fourth region of said second paper support member to define a spiral-shaped passage therebetween, said second paper support member being further positioned, configured and dimensioned to lie between consecutive turns of said first paper support member with said narrow third region adjacent said other longitudinal side of said first paper support member opposite said narrow first region of said first paper support member, voltage means coupled to said first region and said third region for applying a voltage potential difference between said first and said second paper support members.

3. A particle collector as in claim 2, wherein said wide second region and said wide fourth region are each divided into a region of relatively high conductivity and a region of relatively low conductivity, the conductivity of both said regions of relatively high conductivity and said regions of relatively low conductivity being far less than the conductivity of said narrow first region and said narrow third region.

4. An electrostatic particle collector, comprising a first paper support member having a length and width, and a thickness much smaller than said length and said width, said first paper support member having two longitudinal sides, said first paper support member including a narrow first region, said narrow first region having a length and a width and being positioned adjacent one of said longitudinal sides and opposite the other of said longitudinal sides, and a wide second region having a length and a width and positioned adjacent said narrow first region and in contact therewith, said narrow first region having a width narrower than the width of said wide second region, said narrow first region being impregnated with a first concentration of a conductive material and said wide second region being impregnated with a second concentration of a conductive material, said first concentration containing a higher concentration of said conductive material than does said second concentration, a second paper support member having a length and width, and a thickness much smaller than said length and said width, said second paper support member having two longitudinal sides, said second paper support member being positioned in facing spaced relationship to said first paper support member, said second paper support member including a narrow third region having a length and a width adjacent one of said longitudinal sides and a wide fourth region having a length and a width and positioned adjacent said narrow third region and in contact therewith, said narrow third region having a width narrower than the width of said wide fourth region, said narrow third region being impregnated with a first concentration of a conductive material and said wide fourth region being impregnated with a second concentration of a conductive material, said first concentration containing a higher concentration of said conductive material than does said second concentration, said second paper support member being positioned with its wide fourth region in facing spaced relationship to said wide second region of said first paper support member to define a passage therebetween, said second paper support member being further positioned, configured and dimensioned to lie adjacent said first paper support member with said narrow third region adjacent said other longitudinal side of said first paper support member opposite said narrow first region of said first paper support member, voltage means coupled to said first region and said third region for applying a voltage potential difference between said first and said second paper support members.

* * * * *